United States Patent [19]

Todoroki et al.

[11] Patent Number: 4,887,940

[45] Date of Patent: Dec. 19, 1989

[54] MULTISTAGE FLUID MACHINE

[75] Inventors: Yasumasa Todoroki; Haruo Miura, both of Ibaraki; Shigenobu Ohashi, Tsuchiura, all of Japan

[73] Assignee: Hitachi, Ltd., Tokyo, Japan

[21] Appl. No.: 222,429

[22] Filed: Jul. 21, 1988

[30] Foreign Application Priority Data

Jul. 23, 1987 [JP] Japan ..... 62-184271

[51] Int. Cl.[4] ..... F02D 29/20

[52] U.S. Cl. ..... 415/199.1; 416/200 A

[58] Field of Search ..... 415/119, 199.1, 199.2, 415/193; 416/203, 198 R, 198 A, 200 R, 200 A

[56] References Cited

U.S. PATENT DOCUMENTS

| | | | |
|---|---|---|---|
| 2,619,318 | 11/1952 | Schaer | 416/200 A |
| 3,432,884 | 3/1969 | Lysakowski et al. | 416/200 A |
| 4,224,010 | 9/1980 | Fujino | 415/199.2 |
| 4,427,343 | 1/1984 | Fosdick | 416/200 A |

FOREIGN PATENT DOCUMENTS

| | | | |
|---|---|---|---|
| 221559 | 12/1906 | Fed. Rep. of Germany | 416/203 |
| 568402 | 1/1933 | Fed. Rep. of Germany | 416/203 |
| 50299 | 3/1985 | Japan | 416/200 A |
| 1225924 | 4/1986 | U.S.S.R. | 415/199.2 |

*Primary Examiner*—Robert E. Garrett
*Assistant Examiner*—John T. Kwon
*Attorney, Agent, or Firm*—Antonelli, Terry & Wands

[57] ABSTRACT

A multistage fluid machine includes a casing, a rotary shaft, and a plurality of impellers mounted on the rotary shaft in a multistage arrangement. The impellers are fixed to the rotary shaft in such a manner that, when the impellers are projected on a plane normal to the rotary shaft, all the blades of the impellers are shifted out of phase with respect to each other in the circumferential direction on that plane in order to reduce the vibrations of the casing.

2 Claims, 2 Drawing Sheets

MULTISTAGE FLUID MACHINE

BACKGROUND OF THE INVENTION

1. FIELD OF THE INVENTION

The present invention relates to a multistage fluid machine, and, more particularly, to a multi-stage fluid machine with a reduced noise the level.

2. DESCRIPTION OF THE PRIOR ART

Multistage fluid machines include a single-shaft multistage centrifugal compressor, with the compressor of this type has a casing, a rotary shaft supported by the casing, a requisite number of impellers mounted on the rotary shaft, and a driving device for rotating the rotary shaft. In this compressor, the fluid which is sucked from its suction nozzle is pressurized by a first impeller and is then sucked by a second impeller for a subsequent stage where it is further pressurized. The same operation is repeated until the fluid is finally discharged from a discharge nozzle. Thus, the compressor converts the energy imparted by the driving device to an increase in the pressure of the fluid. However, part of the energy escapes from the compressor as noise. The generation of this noise will be described below.

Each of the impellers has a finite number of blades. Therefore, at the outlet of one impeller, the velocity of the fluid is distributed in the circumferential direction in accordance with the number of blades of the impeller, and this periodic fluid velocity distribution rotates together with the impeller. Consequently, a stationary wall receives from the fluid an exciting force having a frequency expressed by a product of the number of blades of one impeller and the rotational speed thereof (this frequency being called a blade passing frequency and referred to hereinafter as BPF). The exciting force having the above-described frequency is transmitted to a casing through diffuser vanes and diaphragms, vibrating the surface of the casing. The vibrations generated on the surface of the casing are noises.

Another type of noise is caused by the vortex flow sound of the fluid which is transmitted through the casing. However, the vibrations generated on the surface of the casing are the main cause of noise generation.

In addition to these noises, noise may also be caused by the fact that harmonic vibrations of low frequency occur in which the casing is vibrated as one lump Japanese patent Laid-Open No. 60-50299 discloses a technique for reducing the level of noise caused by these harmonic vibrations by adopting an arrangement in which the diffuser vanes or the blades of the impellers are out of correspondence with one another in sequence in the circumfernetial direction.

In a multistage fluid machine of the single shaft multistage centrifugal compressor type, since the casing is large, the level of noise caused by the oscillatory waves generated on the surface of the casing, i.e., the level of noise caused by the exicting forces having a BPF, is high. Further, since a fluid machine of the above-described type is rotated at a relatively high speed while the number of blades in one impeller is large, the BPF often reaches about 1 to 2 kHz which ensures that the resulting noise will be at a level which is most uncomfortable for any human beings in the vicinity. Accordingly, there has been a demand for a reduction in the level of noise associated with such a BPF. However, in the known multistage fluid machine, sufficient consideration has not been given to reducting the level of noise caused by vibrations generated on the surface of the casing due to the exciting forces associated with a BPF.

SUMMARY OF THE INVENTION

An object of the present invention is to provide a multistage fluid machine which enables vibrations having a BPF occurring on the surface of a casing to be reduced by a reduction in the force of the fluid at the outlet of an impeller which excites the surface of the casing, thereby lowering the level of noise generated by the multistage fluid machine.

To this end, the present invention provides a multistage fluid machine including a casing, a rotary shaft, and a plurality of impellers mounted in a multistage arrangement on the rotary shaft in the casing, characterized in that, when the impellers are projected on a plane normal to the rotary shaft, all the blades of all the impellers are out of correspondence with one another in the circumferential direction on that plane without any overlapping.

In terms of the impeller for each stage, it is impossible to eliminate occurrence of vibrations on the surface of the casing which are generated by exciting forces of the above-described BPF which are in turn caused by the rotation, together with the impellers, of the fluid velocity distribution at the outlet of each impeller which depends upon the number of blades thereof. The vibrations on the surface of the casing having the BPF caused by the multistage impellers affect each other. The wavelength of the oscillatory waves on the surface of the casing having the BPF ,in the axial direction of the casing is generally longer than the distance between adjacent impellers in the axial direction. With regard to a plurality of impellers each having the same number of blades, therefore, if the blades of adjacent impellers are aligned in the circumferential direction or if they are shifted out of phase with each other in the circumferential direction by a very small distance, the vibrations of the casing having the BPF caused by the impellers are combined with one another in such a manner so as to be accelerated, and the intensity of vibration of the casing thereby increases. However, with the plurality of impellers each having the same number of blades employed in the present invention, since adjacent impellers are shifted out of phase from each other in the circumferential direction by one half of the blade pitch or by an angle which is as close to one half of the blade pitch as possible, the vibration of the casing having the BPF caused by the impellers is substantially eliminated. Further, when the blades of the impellers are disposed in the above-described manner, no impellers have their blades disposed in the same phase. Therefore, the vibrations of the casing having the BPF can be minimized as a whole.

Other objects, features and advantages of the present invention will become more apparant from the following description of the preferred embodiment thereof, taken in conjunction with the accompanying drawings.

DESCRIPTION OF THE PREFERRED EMBODIMENT

Figure 1:
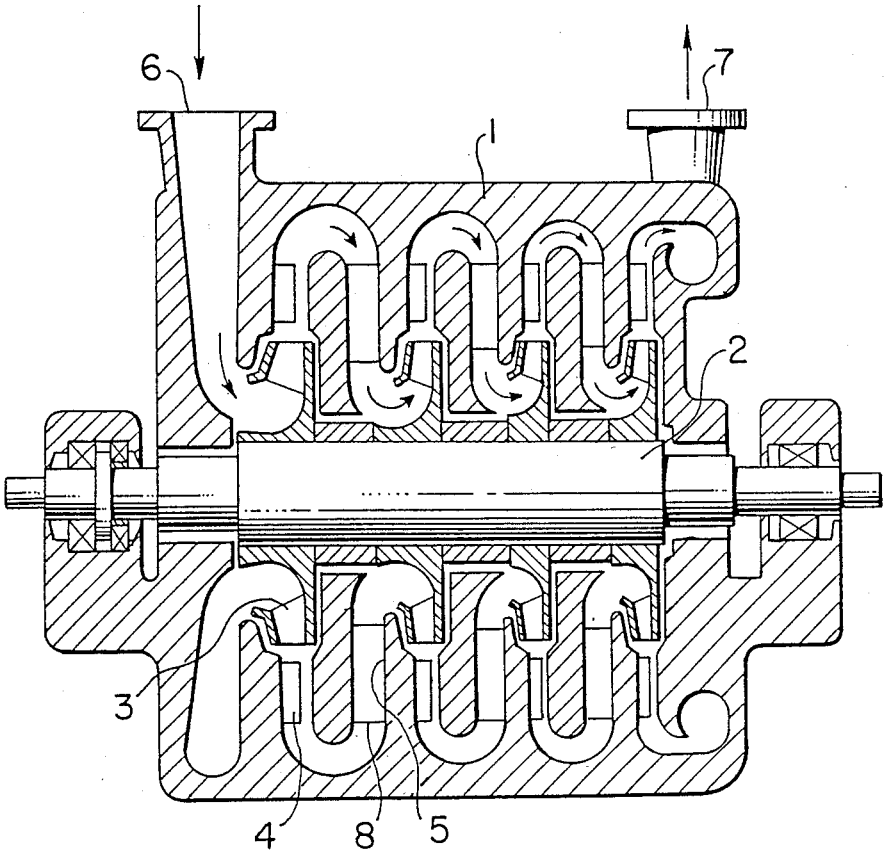
FIG. 1 is a vertical cross-sectional view of a single-shaft multistage centrifugal compressor which is employed in the present invention as a multistage fluid machine.

An embodiment of the present invention will be described below by way of example with reference to FIG. 1 which illustrates a single-shaft multistage centrifugal compressor which includes a casing 1, a rotary shaft 2 supported by the casing 1, a requisite number of impellers 3 mounted on the rotary shaft 3, and a driving device (not shown) for rotating the impellers 3. The fluid, is sucked from a suction nozzle 6 is pressurized by a first impeller which conducts the first stage of operation, passes through a stationary passageway which is formed by a diaphragm 5 and is then sucked into a second impeller provided for a subsequent stage where it is further pressurized. Thereafter, the same operation is repeated until the fluid is finally discharged from a discharge nozzle 7. Each of the diaphragms 5 is provided with a diffuser vane 4 and a return vane 8. Thus, the energy imparted by the driving device is converted to an increase in the pressure of the fluid.

In the above-described single-shaft multistage centrifugal compressor, the characteristics of an impeller and the number of necessary impellers are determined by the relationship between the flow rate/compression ratio and the work that can be done by one impeller. Therefore, impellers which are mounted in a multistage arrangement between the suction side and the discharge side of the compressor may have the same number of blades, or may be different in terms of the number of blades in one impeller. The present invention can be applied to an impeller group consisting of a plurality of impellers each having the same manner of blades.

Figure 2:
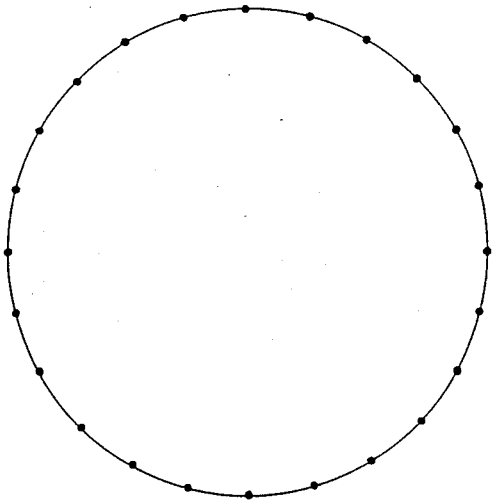
FIG. 2 shows distribution of the outlets of the blades of all the impellers which is obtained when they are projected on a plane normal to the rotary shaft.

Such an impeller group will be considered below. FIG. 2 illustrates the positional relationship of the outlets of all the blades of all the impellers, which is obtained by projecting all the impellers on a plane normal to the rotary shaft (this positional relationship being applied to an impeller group consisting of six impellers each having four blades). As can be seen from FIG. 2, the outlets of all the blades are uniformly or equiangularly distributed in the circumferential direction on the projected plane, without any overlapping. In other words, the impellers are mounted on the rotary shaft in such a manner that the above-described distribution conditions are satisfied.

Further, while satisfying the above-described distribution conditions, the impellers are mounted on the rotary shaft in such a manner that the blades of adjacent impellers are shifted out of phase in the circumferential direction by one half of the blade pitch in each impeller or by an angle which is as close to one half of the blade pitch as possible. Such a mounting will be described in detail with reference to FIGS. 3 and 4.

Figure 3:
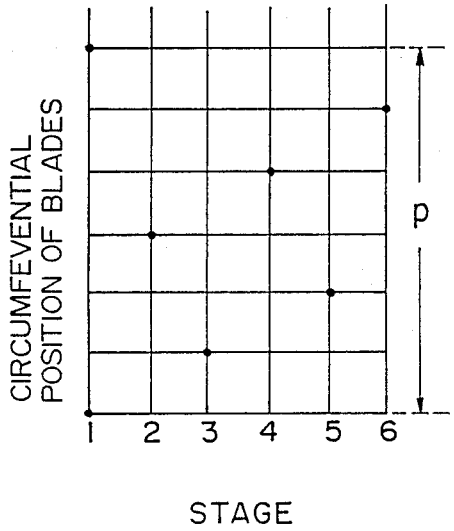
FIG. 3 illustrates is a graphical illustration of the circumferential position of the blades of six impellers employed in the embodiment of the present invention.
Figure 4:
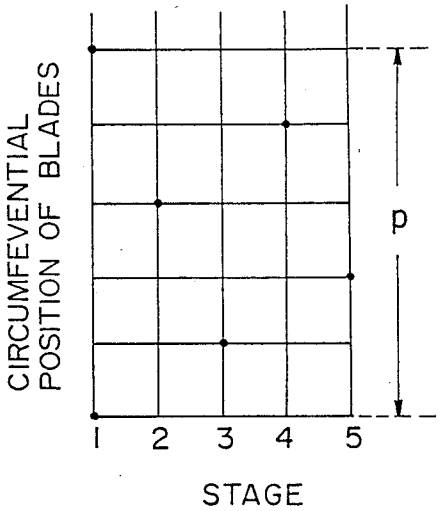
FIG. 4 illustrates is a graphical illustration of the circumferential position of the blades of five impellers.

In FIGS. 3 and 4, the ordinate designates the circumferential position of the outlets or the blades in each impeller, where p is the blade pitch in each impeller (a pitch between adjacent blades in one impeller). The abscissa designates the stage for which the impellers are provided, where several horizontal lines drawn in the figures denote those obtained by dividing the pitch p by the number of stages.

In the impeller group consisting of six impellers shown in FIG. 3, the blades of the impeller for the second stage are out of phase with those of the impeller for the first stage in the circumferential direction by $\frac{1}{2}$ pitch. The blades of the impeller for the third stage are shifted out of phase with those of the impeller for the second stage by $\frac{1}{3}$ pitch, while they are out of phase with those of the impeller for the fourth stage by $\frac{1}{2}$ pitch. The blades of the impeller for the fourth stage are out of correspondence with those of the impeller for the third stage by $\frac{1}{2}$ pitch, while they are out of phase with those of the impeller for the fifth stage by $\frac{1}{3}$ pitch. The blades of the impeller for the fifth stage are shifted out of phase with those of the impeller in the fourth stage by $\frac{1}{3}$ pitch, while they are out of correspondence with those of the impeller for the sixth stage by $\frac{1}{2}$ pitch. More specifically, the blades of adjacent impellers for the first and second stages, third and fourth stages and fifth and sixth stages are distributed in the circumferential direction by an angle which is p/2 in the positive direction (or in the negative direction), while those of adjacent impellers for the second and third stages and fourth and fifth stages are shifted out of phase by an angle which is (p/2−p/s) in the negative direction (or in the positive direction), where s is the number of stages which is six in this example. Blades of the impellers may be arranged in the same manner as described above even when the number of stages is another even number other than six.

In the impeller group consisting of five impellers shown in FIG. 4, the blades of adjacent impellers for the first and second stages and third and fourth stages are distributed in the circumferential direction by an angle which is 3/5 P (this being selected as the value closest to p/2 among the values obtained by equally dividing p by the number of stages s which is equal to 5 in the example) in the positive direction (or in the negative direction), while those of the impellers for the second and third stages and fourth and fifth stages are shifted out of phase by an angle which is (3/5 P−1/5 P) in the negative direction (or in the positive direction). Circumferential distribution of the blades of adjacent impellers can be determined in the same manner as described above even when the number of stages is an odd number other than five.

The impellers are mounted on the rotary shaft in the above-described angular relationship in the circumferential direction.

Adjacent impellers are generally separated from each other by several centimeters or several tens of centimeters, because the diaphragm 5 is provided therebetween in order to form a stationary flow passageway. If the vibration frequency (BPF) is 2 KHz, the wavelength of the oscillatory waves associated with the BPF which is transmitted through the casing is about 70 cm. Therefore, if the blades of adjacent impellers are aligned or substantially aligned in the circumferential direction, the exciting forces are combined with each other, and the level of noise thereby increases. However, in the present invention, since the blades of adjacent impellers are shifted out of phase by one half of the blade pitch or the angle which is as close to it as possible, the combined exciting forces can be minimized. Further, since no impellers have their blades disposed in the same phase, the vibrating forces can be minimized, thereby lowering the level of noise.

As will be understood from the foregoing description, in the present invention, the exciting forces associated with BPF in the multistage fluid machine are eliminated. Consequently, the intensity of vibrations and the level of noise can be reduced, while the function, performance and efficiency of the multistage fluid machine are maintained.

What is claimed is:

1. A multistage fluid machine including a casing, a rotary shaft, and a plurality of impellers each having the same number of blades and mounted on said rotary shaft in a multistage arrangement, said impellers are fixed to said rotary shaft in such a manner that when said impellers are projected on a plane normal to said rotary shaft, all of the blades of said impellers are shifted out of phase with respect to each other in a circumferential direction on said plane without overlapping each other so that the amount of shift between the adjacent blades becomes maximum, and wherein the blades of any one impeller and those of adjacent impellers are shifted out of phase with respect to each other in a circumferential direction by an angle which is one half of a blade pitch of each impeller.

2. A multistage fluid machine including a casing, a rotary shaft, and a plurality of impellers each having the same number of blades and mounted on said rotary shaft in a multistage arrangement, said impellers are fixed to said rotary shaft in such a manner that when said impellers are projected on a plane normal to said rotary shaft, all of the blades of said impellers are shifted out of phase with respect to each other in a circumferential direction on said plane without overlapping each other so that the amount of shift between the adjacent blades becomes maximum, and wherein the blades of any one impeller and those of adjacent impellers are shifted out of phase with respect to each other in the circumferential direction by an angle which is as close to one half of the blade pitch of each impeller as possible.

* * * * *